US008574090B1

(12) United States Patent
Veres

(10) Patent No.: US 8,574,090 B1
(45) Date of Patent: Nov. 5, 2013

(54) FOOT ANCHOR FOR GOLF

(71) Applicant: Joseph R. Veres, Canonsburg, PA (US)

(72) Inventor: Joseph R. Veres, Canonsburg, PA (US)

( * ) Notice: Subject to any disclaimer, the term of this patent is extended or adjusted under 35 U.S.C. 154(b) by 0 days.

(21) Appl. No.: 13/762,822

(22) Filed: Feb. 8, 2013

(51) Int. Cl.
*A63B 69/36* (2006.01)

(52) U.S. Cl.
USPC ..... 473/217; 473/273; 473/451

(58) Field of Classification Search
USPC ..... 473/217, 269, 270, 273, 451–452
See application file for complete search history.

(56) References Cited

U.S. PATENT DOCUMENTS

| | | | | |
|---|---|---|---|---|
| 3,614,107 | A | 10/1971 | Kinsey | |
| 4,088,325 | A | 5/1978 | Sutton | |
| 4,407,079 | A | 10/1983 | Chiroff | |
| 5,318,290 | A * | 6/1994 | Sawyer | 473/217 |
| 5,810,673 | A * | 9/1998 | Castleberry | 473/217 |
| 6,749,529 | B1 * | 6/2004 | Sobolewski | 473/451 |
| 7,625,294 | B1 | 12/2009 | Isaac et al. | |
| 7,722,473 | B1 | 5/2010 | Shah | |
| 8,177,653 | B2 * | 5/2012 | Antolick | 473/217 |
| 2009/0029789 | A1 | 1/2009 | Davies | |

* cited by examiner

*Primary Examiner* — Nini Legesse
(74) *Attorney, Agent, or Firm* — Montgomery Patent & Design; Robert C. Montgomery

(57) ABSTRACT

A rotating foot anchor comprises a base, a pivot pin, and a spring strap. The foot of a user is placed on the base and beneath the spring strap. The foot anchor provides smooth rotation of the user's foot during a follow-through of a golf swing. The pivot pin comprises a downward pointed protrusion which penetrates a ground surface to further secure the device. As the user swings a golf club, the pivot pin enables the foot anchor along with the user's foot to rotate and therefore relive stress applied to the player's knees and back.

13 Claims, 4 Drawing Sheets

FOOT ANCHOR FOR GOLF

RELATED APPLICATIONS

There are no current co-pending applications.

FIELD OF THE INVENTION

The presently disclosed subject matter is directed toward golfing aids. More particularly the present invention includes a golfing aid for providing smooth rotation of a player's foot during golf swing follow-through.

BACKGROUND OF THE INVENTION

One (1) of the most popular games in the US and around the world is golf. With approximately twenty-thousand (20,000) golf courses in the US alone, golf represents not only an enjoyable game but a major economic activity.

Golf has a well-earned reputation of being a challenging game of skill. Playing a perfect game of golf is an elusive goal that players spend a lifetime attempting to achieve. Because of the difficulty of mastering golf, almost every golf course has a pro that provides golf instruction. Numerous golf stores, colleges and high schools offer instruction, and there is always a friend to go to for help. In addition, there are numerous golf aids available.

One (1) aspect of golf that is particularly difficult to achieve is obtaining a long driving distance. One (1) of the many keys to obtaining a long driving distance is obtaining a proper synchronization between hip and shoulder rotations. Furthermore obtaining such a proper synchronization involves achieving proper foot rotation when following through. Without proper foot rotation maximum distance and accuracy cannot be achieved. In addition, without proper foot rotation soreness and injury to knees and hips can result. Age only compounds the problem. In fact, as one ages proper foot rotation becomes more difficult.

In view of the importance of achieving proper foot rotation a device for assisting such foot rotation would be useful. Preferably, such a device would be useful for training proper foot rotation and for reducing body stresses.

SUMMARY OF THE INVENTION

The principles of the present invention provide for a device for assisting golfer's foot rotation. That device is a golfer foot anchor that is useful both for training proper foot rotation and for reducing body stresses.

A golfer foot anchor that is in accord with the present invention includes a base plate having a substantially flat bottom surface and a base plate aperture. The base plate sits on a rotating disc having a substantially flat top surface that is in contact with the bottom surface. The rotating disc further includes a disc aperture. A pivot pin passes through the base plate aperture and the disc aperture to pin the rotating disc to the base plate. Furthermore, a spring strap assembly is attached to the base plate. The spring strap assembly is used to compliantly attach the shoe of a user to the base plate.

Preferably the rotating disc is a cup-shaped member having an upward-facing open side for contacting a ground so as to support the base plate above that ground. The pivot pin is beneficially a metal fastening device having an intermediate minor diameter which entraps the base plate and the rotating disc together. Preferably the pivot pin includes a bottom point that extends below the rotating disc so as to enable penetration into a subjacent ground.

The base plate preferably includes a non-skid top surface such as grooves and/or ribs. In practice the top surface may be comprised of rubber. To assist rotation, the rotating disc may be comprised of a low friction material such as TEFLON®. To assist the player, the spring strap assembly includes a spring strap that is attached to the base plate. A protective sleeve covers at least part of the spring strap, while there is at least one (1) guide rod that is attached to the base plate and is located within the spring strap.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | golfer foot anchor |
| 20 | base plate |
| 22 | non-skid surface |
| 30 | spring strap assembly |
| 32 | spring strap |
| 34 | sleeve |
| 36 | guide rod |
| 40 | rotating disc |
| 42 | pivot pin |
| 44 | anchoring feature |
| 80 | fastener |
| 100 | user/golfer |
| 105 | shoe/foot |
| 110 | pivoting motion |
| 115 | rotary motion |
| 120 | ground surface |

DETAILED DESCRIPTION OF THE PREFERRED EMBODIMENT

The best mode for carrying out the invention is presented in terms of its preferred embodiment, herein depicted within FIGS. 1 through 4*b*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
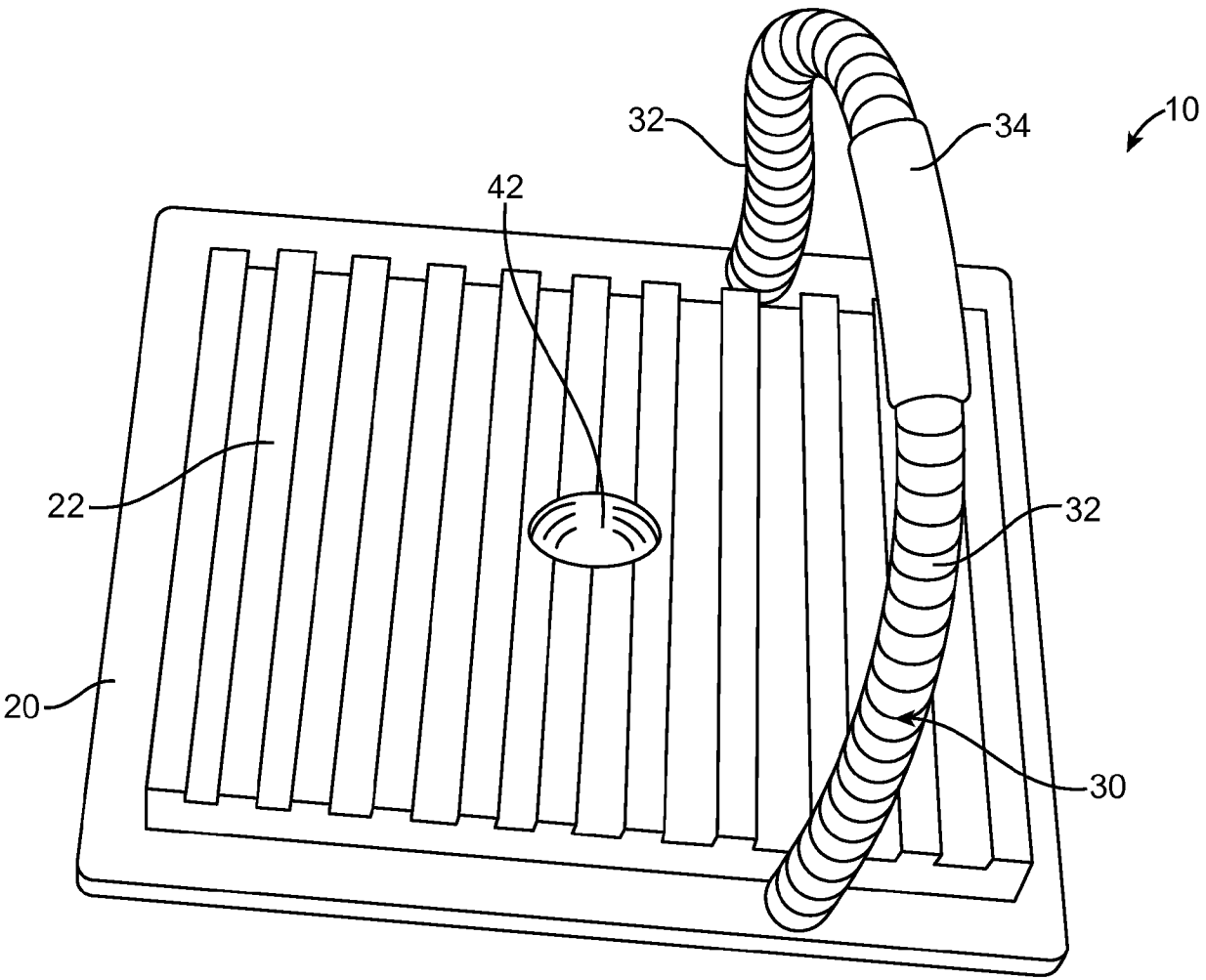
FIG. 1 is a perspective view of a golfer foot anchor 10 that is in accord with a preferred embodiment of the present invention.

Refer now to FIG. 1, which is a perspective view of a golfer foot anchor 10 that is in accord with a preferred embodiment of the present invention. The golfer foot anchor 10 comprises a base plate 20, a rotating disc 40 (see FIGS. 3*a* and 4*b*), a pivot pin 42, and a spring strap assembly 30. The base plate 20 comprises a rigid flat surface that is approximately six inches (6 in.) on each side and approximately one-quarter-inch (¼ in.) thick. The base plate 20 includes a ribbed or grooved rubber or similar material to provide a non-skid top surface 22 using industrial adhesives. This provides stable, high-friction contact between the golfer foot anchor 10 and the shoe/foot 105 of the user/golfer 100 during use.

Figure 2:
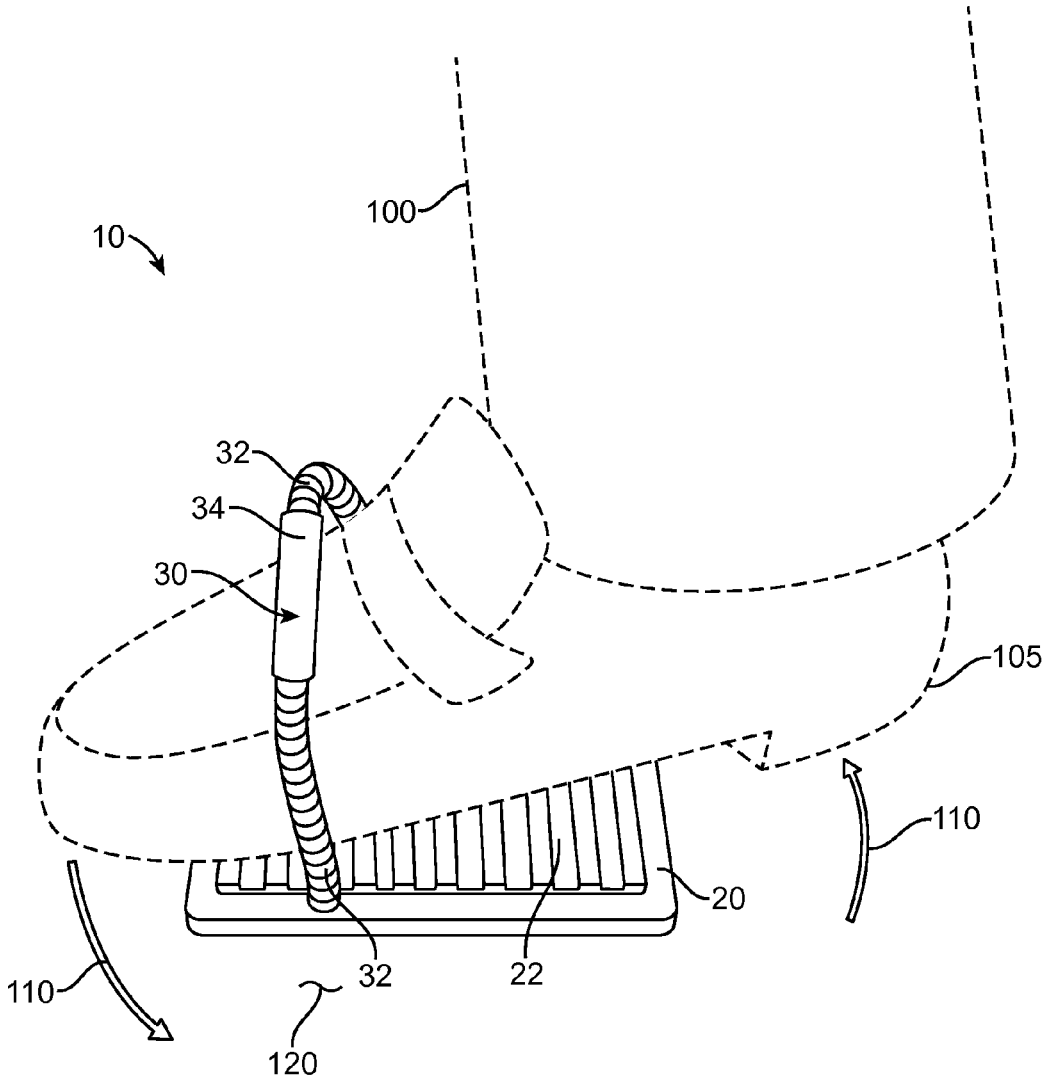
FIG. 2 is an environmental view of the golfer foot anchor 10 shown in FIG. 1 when in an in-use state.

FIG. 2 presents an environmental view of an in-use rotating foot anchor for a golfer 10. The shoe/foot 105 of a user/golfer 100 is loosely inserted through the spring strap assembly 30. This locates the shoe/foot 105 on the base plate 20, thereby causing the base plate 20 and strap assembly 30 to contact and rotate along with the foot/shoe 105 during the follow-through of the user/golfer's 100 golf swing as indicated by the pivoting motion 110 arrows. The golfer foot anchor 10 is designed for use on either a right or a left shoe/foot 105 of the user/golfer 100.

Figure 3B:
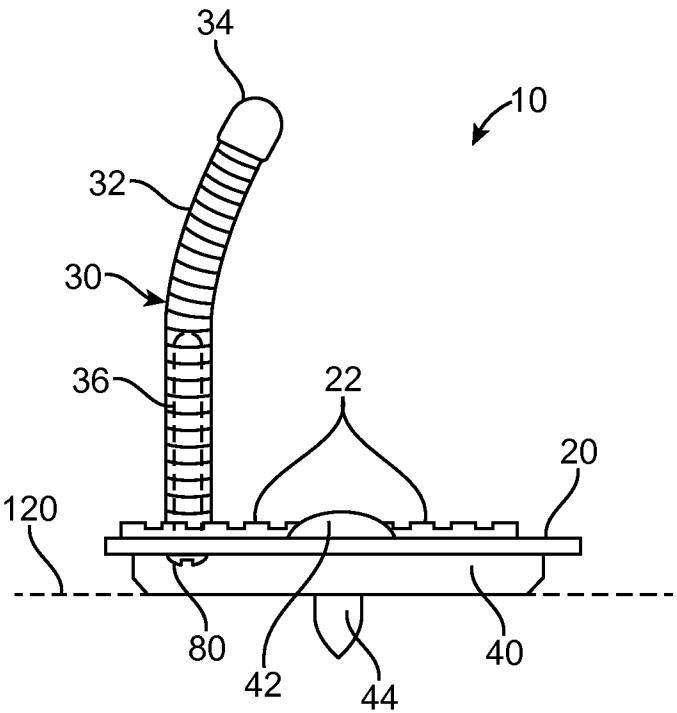
FIG. 3*b* is a side view of the golfer foot anchor 10 shown in FIGS. 1, 2, and 3*a;*
Figure 3A:
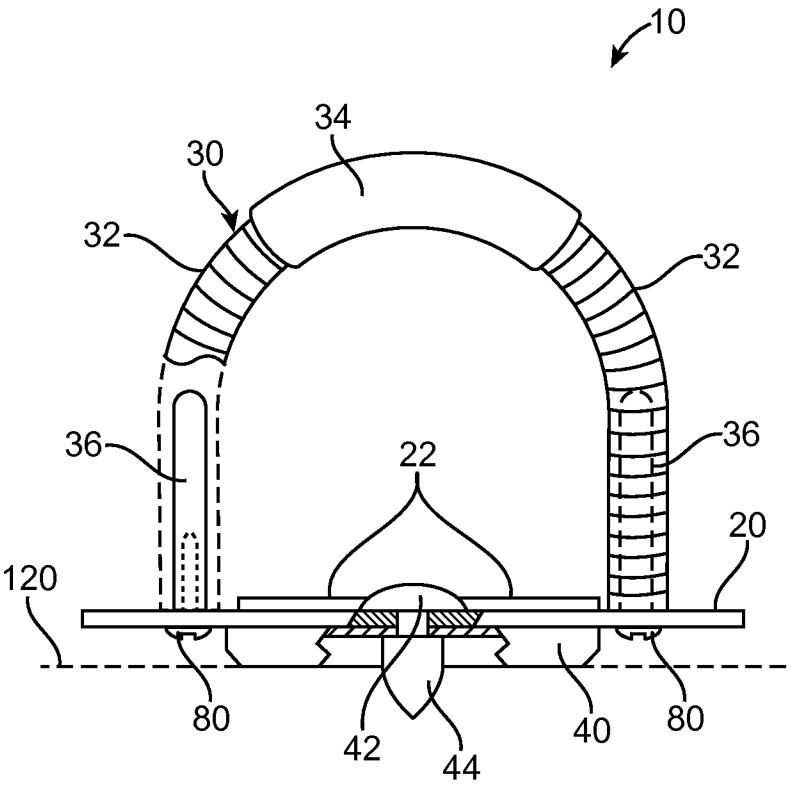
FIG. 3*a* is a front view of the golfer foot anchor 10 shown in FIGS. 1 and 2.

The spring strap assembly 30 further comprises a spring strap 32, a protective sleeve 34 over the spring strap 32, and a pair of guide rods 36 within the spring strap 32 (see FIG. 3*a*). The spring strap 32 is a flexible length-adjustable member which compliantly fits over a user's shoe 105. This allows the spring strap assembly 30 to fit around differently-sized shoes/feet 105.

Refer now to FIGS. 3*a*, 3*b*, 4*a*, 4*b* for various views of the golfer foot anchor 10. The base plate 20 attaches to a subjacent rotating disc 40 via a pivot pin 42. The pivot pin 42 positions the flat bottom of the base plate 20 against the flat top of the rotating disc 40. The rotating disc 40 is a low-profile cup-shaped member having an upwardly-facing open side with a sufficient diameter to stabilize the golfer foot anchor 10 upon a flat or grassy ground surface 120. The pivot pin 42 comprises a metal fastening device having an intermediate minor diameter onto which apertures of the base plate 20 and rotating disc 40 are entrapped to hold the base plate 20 and rotating disc 40 together.

Figure 4A:
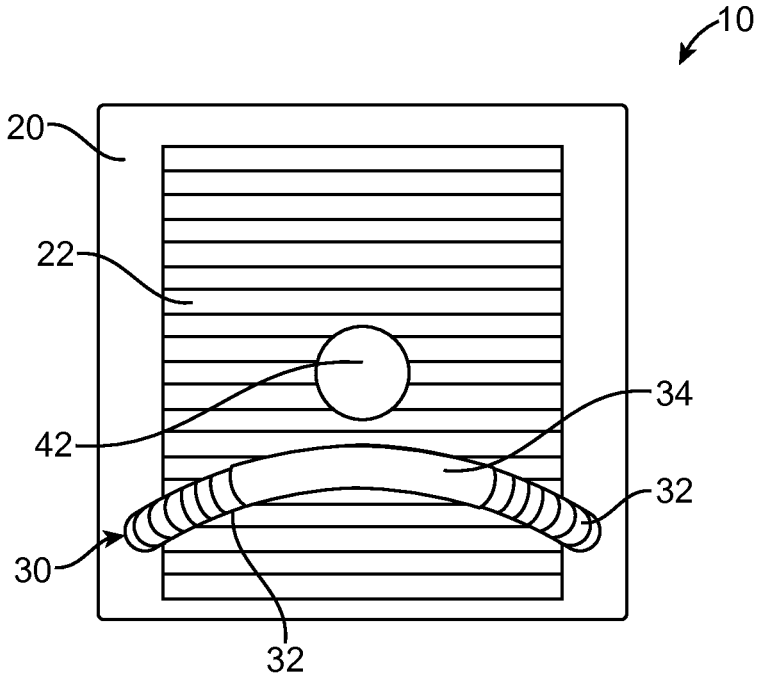
FIG. 4*a* is a top view of the golfer foot anchor 10 shown in FIGS. 1 through 3*b*; and, FIG. 4*b* is a bottom view of the golfer foot anchor 10 shown in FIGS. 1 through 4*a*.
Figure 4B:
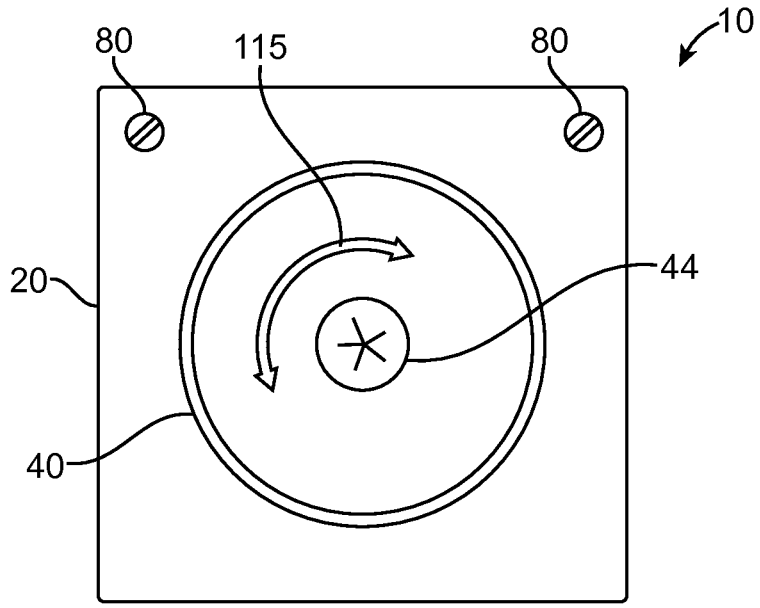

Furthermore, the pivot pin 42 enables relative rotation 115 between the base plate 20 and rotating disc 40 along a vertical axis indicated by an arrow in FIG. 4*b*. The base plate 20 and rotating disc 40 are envisioned to be made from a strong plastic material having a high lubricity characteristic such as TEFLON®, nylon, or the like, thereby providing a smooth relative circular rotation of the base plate 20 during a swing. The pivot pin 42 also includes a pointed anchoring feature 44 that is formed at the bottom end. This allows stable penetration into a subjacent ground 120 to prevent lateral motion of the golfer foot anchor 10.

The spring strap 32 is a length of flexible spring stock having a dense coil pitch. The spring strap 32 is attached to the base plate 20 by entrapping its ends between guide rods 36 and the top surface of the base plate 20. The ends of the spring strap slide over each guide rod 36 which forms an upward protruding length of round stock that is approximately three inches (3 in.) in length and affixed to the base plate 20 via a subjacent threaded fastener 80. The sleeve 34 is a length of plastic tubing which is slipped over the top of the spring strap 32 to protect the user's shoe 105.

It is envisioned that other styles and configurations of the present invention can be easily incorporated into the teachings of the present invention. While only one particular configuration has been shown and described that is for purposes of clarity and disclosure and not by way of limitation of scope.

The preferred embodiment of the present invention can be used by the common user in a simple and effortless manner with little or no training. After initial purchase or acquisition of the golfer foot anchor 10, it would be installed as indicated in FIG. 2.

The method of using the golfer foot anchor 10 may be achieved by performing the following: procuring a golfer foot anchor 10; placing the golfer foot anchor 10 on the ground 120 at an intended location of the user/golfer's 100 leading shoe/foot 105 during a golf swing; stabilizing the golfer foot anchor 10 on the ground 120 by pressing downward on the golfer foot anchor 10 to cause the anchoring feature 44 to penetrate the ground 120; sliding a user's 100 leading shoe/foot 105 into the spring strap assembly 30; executing a normal golf swing while synchronously pivoting the lead shoe/foot 105 and the base plate 20 of the golfer foot anchor 10; and benefiting from reduced stresses to knee and back areas afforded a user 100 of the golfer foot anchor 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A golfer foot anchor, comprising:

a base plate having a substantially flat bottom surface and a base plate aperture;

a rotating disc having a substantially flat top surface in contact with said bottom surface, said rotating disc further including a disc aperture;

a pivot pin passing through said base plate aperture and said disc aperture pinning said rotating disc to said base plate; and, a spring strap assembly attached to said base plate, said spring strap assembly for compliantly attaching a shoe to said base plate;

wherein said rotating disc is a cup-shaped member having an upward-facing open side for contacting a ground surface and to support said base plate above said ground surface.

2. The golfer foot anchor according to claim 1, wherein said pivot pin is a metal fastening device having an intermediate minor diameter which entraps said base plate and said rotating disc together such that said base plate can rotate on said rotating disc.

3. The golfer foot anchor according to claim 2, wherein said pivot pin further includes bottom point.

4. The golfer foot anchor according to claim 3, wherein said bottom point extends below said rotating disc so as to enable penetration into a subjacent ground.

5. The golfer foot anchor according to claim 1, wherein said base plate includes a non-skid top surface.

6. The golfer foot anchor according to claim 5, wherein said top surface includes grooves.

7. The golfer foot anchor according to claim 5, wherein said top surface includes ribs.

8. The golfer foot anchor according to claim 5, wherein said top surface is rubber.

9. The golfer foot anchor according to claim 5, wherein said rotating disc is comprised of a low friction material.

10. The golfer foot anchor according to claim 9, wherein said low friction material is TEFLON®.

11. The golfer foot anchor according to claim 1, wherein said spring strap assembly includes a spring strap attached to said base plate.

12. The golfer foot anchor according to claim 11, wherein said spring strap assembly further includes a protective sleeve over at least part of said spring strap.

13. The golfer foot anchor according to claim 12, wherein said spring strap assembly further includes at least one guide rod attached to said base plate and within said spring strap.

* * * * *